US006464087B1

(12) United States Patent
Klein et al.

(10) Patent No.: US 6,464,087 B1
(45) Date of Patent: Oct. 15, 2002

(54) HANGING SHOE RACK WITH DOUBLE LOOP SHOE RETAINING ARRANGEMENT

(75) Inventors: Richard B. Klein, Overland Park; Chris Serslev, Leawood; John W. Scott, Lenexa, all of KS (US)

(73) Assignee: Lynk, Inc., Lenexa, KS (US)

( * ) Notice: Subject to any disclaimer, the term of this patent is extended or adjusted under 35 U.S.C. 154(b) by 0 days.

(21) Appl. No.: 09/649,305

(22) Filed: Aug. 28, 2000

Related U.S. Application Data

(60) Provisional application No. 60/150,771, filed on Aug. 26, 1999.

(51) Int. Cl.[7] ..... A47F 5/00

(52) U.S. Cl. ..... 211/35; 211/87.01; 211/113; 211/119

(58) Field of Search ..... 211/35, 34, 87.01, 211/113, 118, 119

(56) References Cited

U.S. PATENT DOCUMENTS

| | | | | |
|---|---|---|---|---|
| 953,130 | A | 3/1910 | Fellows | |
| 1,377,444 | A | 5/1921 | Shoemaker | 248/304 |
| 1,401,356 | A | 12/1921 | Parchert | |
| 1,450,948 | A | 4/1923 | Glidden | |
| 1,570,451 | A | 1/1926 | Simoneau | |
| 1,674,359 | A | 6/1928 | Frey | 211/43 |
| 1,703,190 | A | 2/1929 | Glidden | |
| 1,733,487 | A | 10/1929 | Hackley | |
| 1,769,344 | A | 7/1930 | Hoffmire | |
| 2,090,108 | A | 8/1937 | Cicero | 211/35 |
| 2,157,001 | A | 5/1939 | Morley | 248/206 |
| 2,205,817 | A | 6/1940 | Kramb | 24/259 |
| 2,238,884 | A | 4/1941 | Hoffman | 211/38 |
| 2,299,021 | A | 10/1942 | Hoffman | 211/34 |
| D139,415 | S | 11/1944 | Brown | 211/35 X |
| 2,459,909 | A | 1/1949 | Alofs | 248/303 |
| 2,504,910 | A | 4/1950 | Wellington | 221/89 |
| D165,942 | S | 2/1952 | Stein | D80/10 |
| 2,620,929 | A | 12/1952 | Sportsman | 211/42 |
| 2,654,487 | A | 10/1953 | Degener | 211/148 |
| 2,682,955 | A | 7/1954 | Moore | 211/35 |
| 2,701,564 | A | 2/1955 | Wilhelm | 128/75 |
| 2,815,862 | A | 12/1957 | Einhorn | 211/37 |
| 2,845,182 | A | 7/1958 | Atkinson | 211/37 |
| 2,901,117 | A | 8/1959 | Plocki et al. | 211/38 |
| 3,171,542 | A | 3/1965 | Jacobs et al. | 211/43 |
| 3,198,343 | A * | 8/1965 | Pollock | |
| 3,391,793 | A | 7/1968 | Streuli | 211/43 |
| 3,468,426 | A | 9/1969 | Loewy | 211/35 |
| 3,578,282 | A | 5/1971 | Olsen | 248/214 |
| 3,637,084 | A | 1/1972 | Uitz | 211/105.1 |
| 3,792,804 | A | 2/1974 | Ponzo | 223/85 |
| 3,913,745 | A | 10/1975 | Weiss | 211/34 |
| 3,918,670 | A | 11/1975 | Doherty | 211/35 X |
| 3,999,734 | A | 12/1976 | Gibson et al. | 248/460 |
| 4,094,030 | A | 6/1978 | Saad | 12/116.8 |
| 4,199,070 | A | 4/1980 | Magnussen, Jr. | 211/194 X |
| 4,209,098 | A | 6/1980 | Adams | 211/60 |
| 4,245,746 | A | 1/1981 | Aylor | 211/40 |
| 4,343,172 | A | 8/1982 | Norlund | 72/339 |
| 4,457,436 | A | 7/1984 | Kelley | 211/88 |
| 4,463,853 | A | 8/1984 | Licari et al. | 211/37 |
| 4,607,753 | A | 8/1986 | Radek | 211/87 |

(List continued on next page.)

FOREIGN PATENT DOCUMENTS

| | | | |
|---|---|---|---|
| FR | 1 462 095 | 11/1966 | 211/37 |

*Primary Examiner*—Robert W. Gibson, Jr.
(74) *Attorney, Agent, or Firm*—Shook, Hardy & Bacon L.L.P.

(57) ABSTRACT

A shoe rack, for mounting to an upright surface or for hanging over a door, having plastic side frame members and at least one shoe retaining tier positioned between the side frame members. Each shoe retaining tier includes at least one cross-bar having a number of loops extending therefrom. In each embodiment, the loops are oriented in pairs for retaining pairs of shoes thereon.

15 Claims, 18 Drawing Sheets

U.S. PATENT DOCUMENTS

| | | | | | |
|---|---|---|---|---|---|
| D287,550 | S | | 1/1987 | Tocci | D6/315 |
| 4,657,148 | A | | 4/1987 | Heng | 211/128 |
| 4,678,151 | A | | 7/1987 | Radek | 248/220 |
| 4,688,681 | A | | 8/1987 | Bergeron | 211/36 |
| 4,688,687 | A | | 8/1987 | Pryor | 211/189 |
| 4,711,419 | A | | 12/1987 | Polosky | 248/225 |
| 4,754,885 | A | | 7/1988 | Rich | 211/181 |
| 4,805,783 | A | | 2/1989 | Mayer | 211/94 |
| 4,825,601 | A | | 5/1989 | Halverson | 52/36 |
| 4,899,971 | A | | 2/1990 | Elkin | 248/255.1 |
| 4,915,238 | A | | 4/1990 | Cassel | 211/37 |
| 4,942,498 | A | | 7/1990 | Toussaint | 361/388 |
| 4,981,221 | A | | 1/1991 | Davis | 211/37 |
| 5,035,332 | A | | 7/1991 | Stravitz | 211/40 |
| 5,048,698 | A | | 9/1991 | Konrad | 211/45 |
| 5,054,629 | A | | 10/1991 | Breen | 211/128 |
| 5,076,442 | A | * | 12/1991 | Hakeem | 211/34 |
| 5,078,270 | A | | 1/1992 | Campbell | 211/194 X |
| 5,082,125 | A | | 1/1992 | Ninni | 211/184 |
| 5,097,968 | A | | 3/1992 | Gregory | 211/94 |
| 5,101,986 | A | | 4/1992 | Holztrager | 211/13 |
| 5,101,989 | A | | 4/1992 | Jones | 211/94 |
| 5,103,985 | A | | 4/1992 | Davis | 211/37 |
| 5,152,407 | A | | 10/1992 | Massoudnia et al. | 211/181 |
| 5,172,816 | A | | 12/1992 | Klein | 211/27 |
| D354,412 | S | | 1/1995 | Emery | D6/546 |
| D377,728 | S | | 2/1997 | Klein et al. | D6/513 |
| 5,641,079 | A | | 6/1997 | Schmidt | 211/70.1 |
| D381,225 | S | | 7/1997 | Malik | D6/513 |
| D382,434 | S | | 8/1997 | Klein et al. | D6/570 |
| 5,695,073 | A | | 12/1997 | Klein et al. | 211/35 |
| 5,785,185 | A | * | 7/1998 | Klebba | 211/37 |
| D398,787 | S | | 9/1998 | Malik | D6/411 |
| D403,880 | S | | 1/1999 | Malik | D6/411 |
| 5,855,279 | A | | 1/1999 | Klein et al. | 211/35 |
| D407,908 | S | * | 4/1999 | Dickinson et al. | |
| 5,894,940 | A | * | 4/1999 | Gusdorf et al. | 211/35 |
| 5,988,409 | A | * | 11/1999 | Gusdorf et al. | |
| 6,065,613 | A | * | 5/2000 | Gusdorf et al. | 211/34 |

* cited by examiner

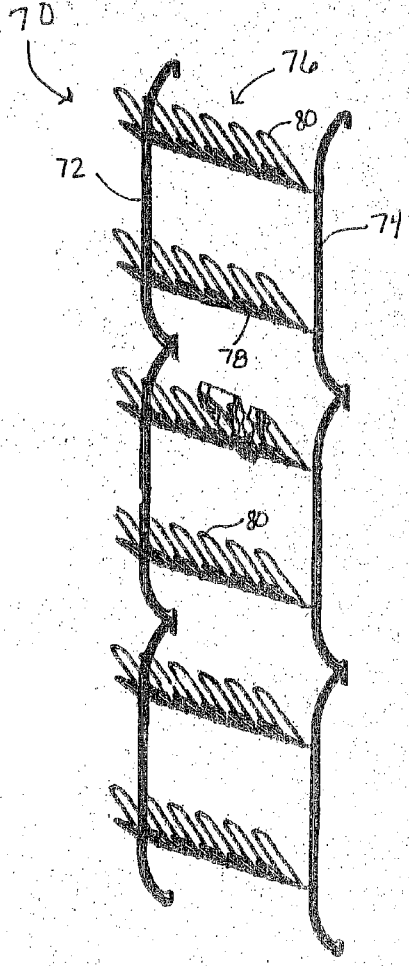
FIG. 13
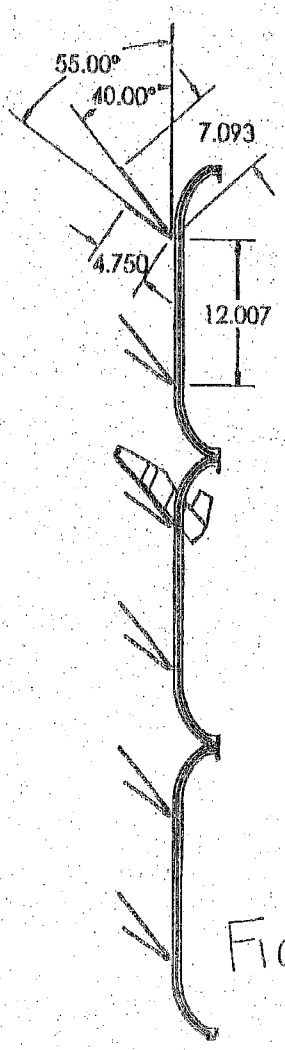
FIG. 14
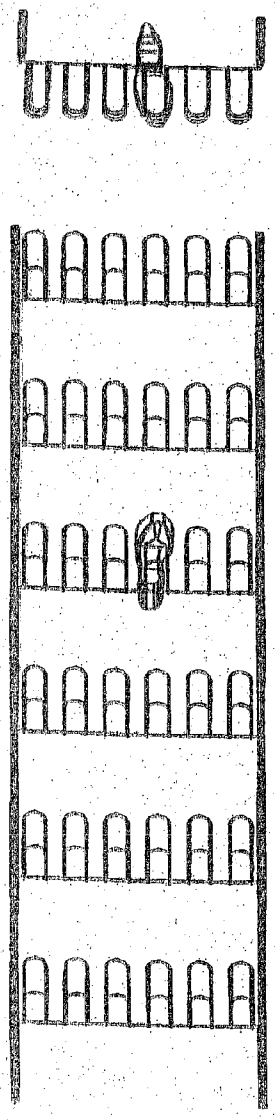
FIG. 15
FIG. 16

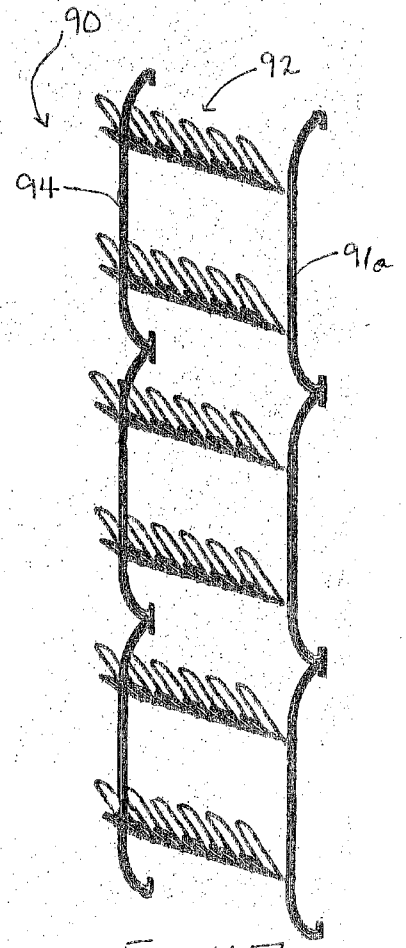
FIG. 17
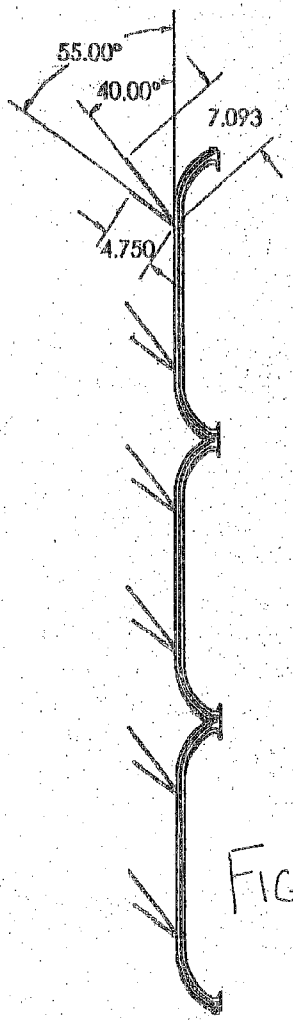
FIG. 18
FIG. 19
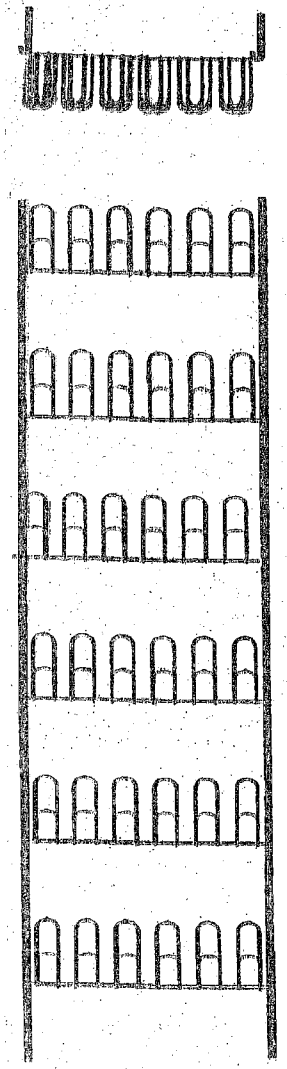
FIG. 20

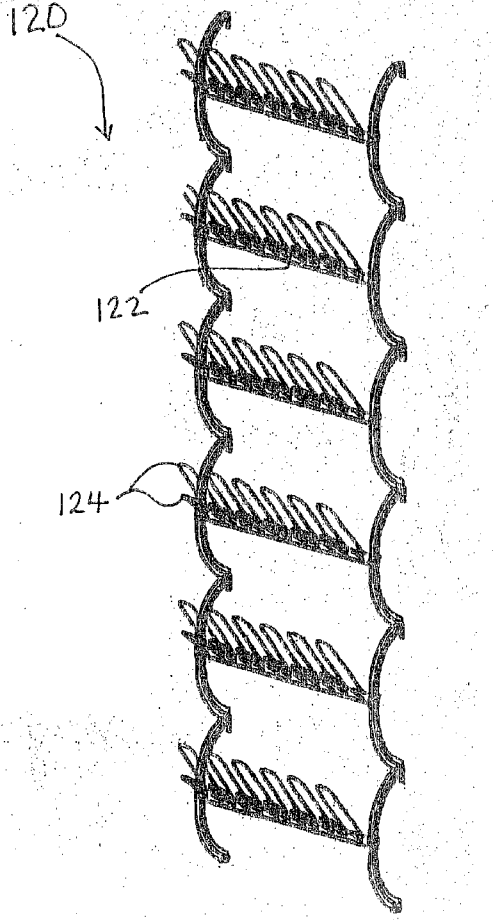
FIG. 25
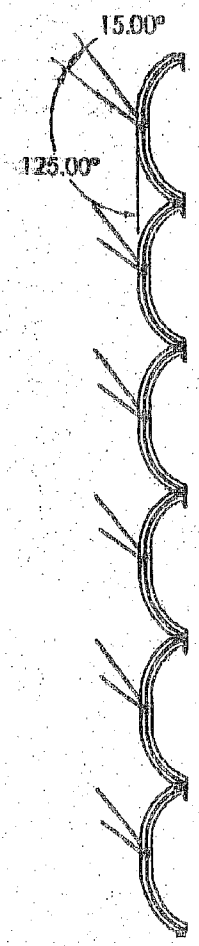
FIG. 26
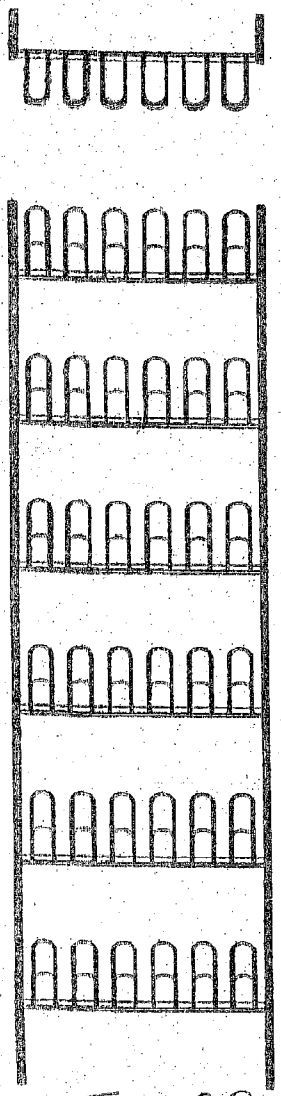
FIG. 27
FIG. 28

HANGING SHOE RACK WITH DOUBLE LOOP SHOE RETAINING ARRANGEMENT

CROSS-REFERENCE TO RELATED APPLICATIONS

The present application claims priority from U.S. Provisional Application Serial No. 60/150,771, filed Aug. 26, 1999, entitled "Hanging Shoe Rack With Double Loop Shoe Retaining Arrangement".

STATEMENT REGARDING FEDERALLY-SPONSORED RESEARCH OR DEVELOPMENT

Not Applicable.

BACKGROUND OF THE INVENTION

The present invention is directed to a hanging shoe rack, and is more particularly directed to a number of different embodiments for shoe racks that hang from, or are positioned on, the back of a door or on another upright surface.

Hanging shoe racks are well known. For example, U.S. Pat. No. 5,695,073, entitled "Hanging Shoe Rack", is directed to a hanging shoe rack having a pair of plastic side frame members, and a plurality of support bars positioned between the side frame members on which shoes may be supported. The present invention is directed to such a product, albeit with different features. U.S. Pat. No. 5,695,073 is incorporated by reference, in its entirety, herein.

In particular, the shoe rack set forth in U.S. Pat. No. 5,695,073 includes first and second plastic side frame members. Each side frame member has as vertical member having a plurality of support arms extending outwardly and downwardly therefrom. The product has a plurality of shoe retaining bars. The shoe retaining bars are oriented in pairs, with each pair of bars aligned in a plane forming an acute angle with respect to the vertical surface on which the shoe rack is positioned. In this regard, one bar of each pair is positioned at outward ends of respective arms, while the other shoe retaining bar of the pair is positioned between the vertical members of the respective side frame members.

As illustrated best in FIG. 2 of U.S. Pat. No. 5,695,073, the vertical members of the plastic side frame members are preferably spatially removed from the upright surface or door, due to the presence of leg members at upper and lower portions of the side frame members. Hangers, or brackets, are positioned over the door and receive foot members extending downwardly from leg members, as clearly illustrated and described in the '073 patent. As illustrated and described, when the hanging shoe rack product is positioned on an upright surface, the vertical members and outwardly and downwardly depending arms serve as lateral barriers to retain the shoes on the shoe rack.

Additionally, U.S. Pat. No. 5,103,985, incorporated herein by reference, teaches a shoe-retaining rack, or cube, having a number of cross-bars, each with a plurality of loop-pairs positioned thereon. In particular, each loop of a pair of loops is positioned upwardly from a corresponding cross-bar, and particularly, extends outwardly from its corresponding cross-bar in a direction opposite that of its corresponding loop in the pair.

SUMMARY OF THE INVENTION

Each embodiment of the present invention is directed to a shoe rack for mounting to an upright surface, or hanging over a door. Each embodiment of the present invention employs side frame members, and one or more shoe retaining tiers, positioned between the side frame members, upon which shoes may be supported. In particular, each embodiment of the present invention employs at least one shoe retaining tier having a plurality of loops thereon, wherein the loops are oriented in pairs. However, each embodiment of the present invention incorporates different structural features, resulting in improved structural integrity over the prior art and/or resulting in a product that is less expensive to manufacture and/or resulting in a product which retains shoes on the shoe rack in a different, or better, manner.

BRIEF DESCRIPTION OF THE DRAWINGS

The objects and features of the invention noted above are explained in more detail with reference to the drawings, in which like reference numerals denote like elements, and in which:

FIG. 13 illustrates a fourth embodiment of the hanging shoe rack of the present invention;

FIG. 14 is a left elevational view thereof;

FIG. 15 is a top plan view thereof;

FIG. 16 is a front elevational view thereof;

FIG. 17 illustrates a fifth embodiment of the hanging shoe rack of the present invention;

FIG. 18 is a left side elevational view thereof;

FIG. 19 is a top plan view thereof;

FIG. 20 is a front elevational view thereof;

FIG. 25 illustrates a perspective view of a seventh embodiment of the hanging shoe rack of the present invention;

FIG. 26 is a left side elevational view thereof;

FIG. 27 is a top plan view thereof;

FIG. 28 is a front elevational view thereof;

FIG. 36*c* is a second variation of the ninth embodiment of the present invention;

DETAILED DESCRIPTION OF THE INVENTION

Figure 1:
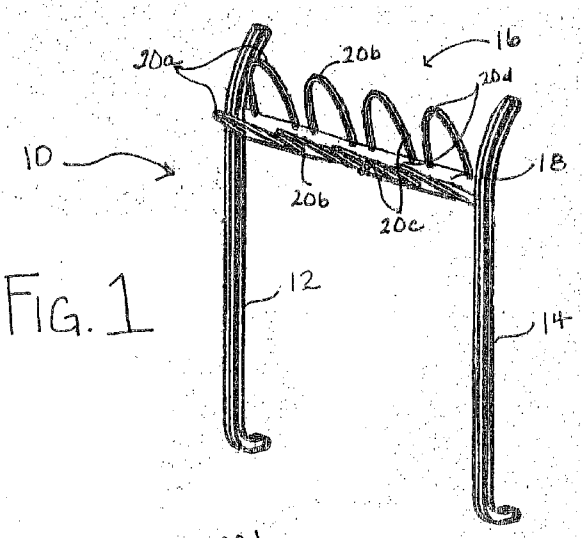
FIG. 1 is a perspective view of a first embodiment of the hanging shoe rack of the present invention.

With reference now to the figures, it is again noted that each embodiment of the present invention employs first and second side frame members, preferably made of either plastic or metal, and a plurality of shoe retaining tiers positioned between the side frame members. Additionally, each embodiment of the present invention preferably employs components or means for mounting the shoe rack to an upright surface, or for hanging the shoe rack over a door. Additionally, each embodiment of the present invention preferably is a modular shoe rack, in that one shoe rack may be connected to another shoe rack of the invention, such as in a manner as that set forth in U.S. Pat. No. 5,695,073, incorporated herein by reference in its entirety, when the side frame members are plastic.

With initial reference to FIGS. 1–4, a hanging shoe rack of the present invention is denoted generally by reference numeral 10. Hanging shoe rack 10 has first and second side frame members 12, 14. In this embodiment, side frame members 12, 14 are preferably made of plastic. At least one shoe retaining tier, denoted generally by reference numeral 16, is positioned between plastic side frame members 12, 14. Shoe retaining tier 16 has a cross-bar 18, preferably formed of plastic, with a plurality of loops 20 thereon. In particular, the loops are preferably formed of plastic and are oriented in pairs, as indicated by loop pairs 20*a*, 20*b*, 20*c*, and 20*d*. Plastic loops 20 may be intergrally molded with the plastic cross-bar 18 or, alternatively, plastic loops 20 are formed separately from plastic cross-bar 18, and are connected thereto. In this regard, each of the loops 20 may be secured to cross-bar 18 by the provision of apertures on cross-bar 18 for receiving outer ends of respective loops 20.

In this embodiment, the shoe retaining tier 16 is positioned between respective side frame members 12, 14, at sides thereof. This connection may be accomplished in any desirable way, but is preferably accomplished through utilization of interlocking and mating connection components or means at the outer ends of cross-bar 18, and on the inner side surfaces of plastic side frame members 12, 14. For example, side frame members 12, 14 may have sockets for receiving outer ends of cross-bar 18, which itself may have posts for snug and secure insertion into respective sockets.

Figure 2:
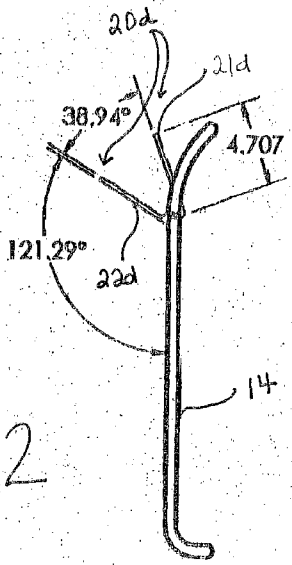
FIG. 2 is a left side elevational view thereof.
Figure 3:
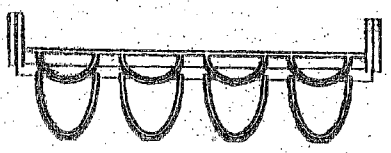
FIG. 3 is a top plan view thereof.
Figure 4:
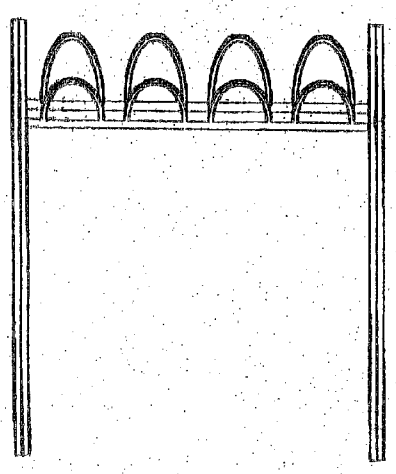
FIG. 4 is a front elevational view thereof.
Figure 5:
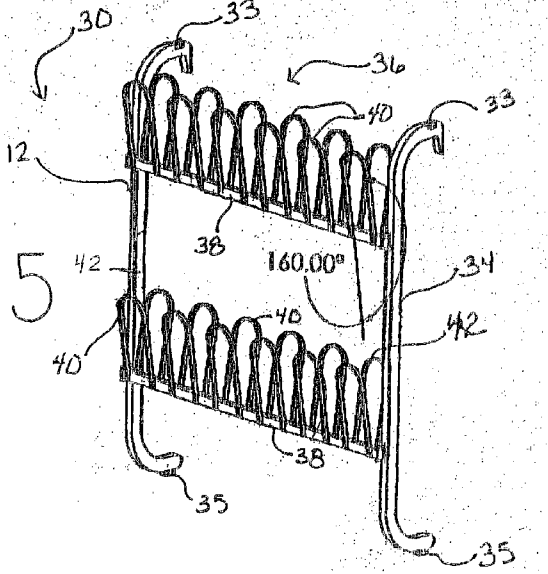
FIG. 5 is a perspective view of a second embodiment of the hanging shoe rack of the present invention.

With particular reference to FIG. 2, the precise orientation of the loops 20 is illustrated. In particular, each loop is preferably of the same dimension, preferably between 4.0 and 5.0 inches in length. More preferably, each loop is approximately 4.70 inches in length. However, a first loop of a loop pair, such as loop pair 20*d*, indicated particularly by reference numeral 21*d*, is positioned higher than a second loop of the loop pair 20*d*, indicated particularly by reference numeral 22*d*.

As illustrated, the second loop 22*d* is preferably between 120° and 125° from vertical, while the first loop 21*d* is preferably between another 35° and 40° from the position of the second loop 22*d*. More preferably, the second loop 22*d* is 121.29° from vertical, while the first loop 21*d* is another 38.94° from the position of the second loop 22*d*. It will be understood and appreciated that different angular orientations may be utilized. In particular, as illustrated, the preferred angular orientation, whether it be that as illustrated, or another angular orientation, results in each of the loops 21*d*, 22*d*, of loop pair 20*d*, (and all other loop pairs) being angled upwardly from its corresponding cross-bar 18, and additionally being angled outwardly from its corresponding cross-bar 18 in the same direction with respect to vertical. In particular, each of the loops 20 is angled outwardly in a direction away from an upright surface on which the shoe rack 10 is positioned and used. As such, each loop is accessible for positioning and retaining a shoe.

With reference now to FIGS. 5–8, a second embodiment of a hanging shoe rack of the present invention is illustrated and described. In particular, with reference now to FIG. 5, a shoe rack of the present invention is denoted generally by reference numeral 30. Hanging shoe rack 30 has first and second side frame members 32, 34, preferably formed of plastic. A plurality of shoe retaining tiers, denoted generally by reference numeral 36, extend between respective side frame members 32, 34. Each shoe retaining tier has a cross-bar 38, preferably formed of plastic, and a plurality of plastic loops 40 extending upwardly and outwardly therefrom.

In particular, in this embodiment, each shoe retaining tier 36 is positioned on a front 42 of the shoe rack 30, and particularly, on a front 42 of each of the respective side frame members 32, 34. Such a connection is accomplished by the provision of interlocking means on the front face 42 of each of the side frame members 32, 34, and on the respective outer ends of cross-bar 38. Each shoe retaining tier 36 could be connected to side frame members 32, 34 in a number of manners. In this regard, while a shoe rack of the present invention has not heretofore been known, the connection of various plastic components one to another is known, and there are many conventional arrangements for accomplishing such connections.

Figure 6:
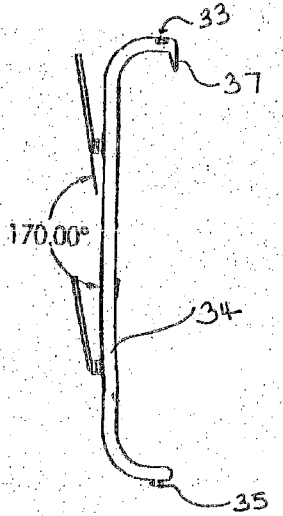
FIG. 6 is a left side elevational view thereof.
Figure 7:
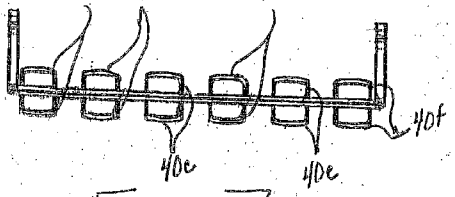
FIG. 7 is a top plan view thereof.
Figure 8:
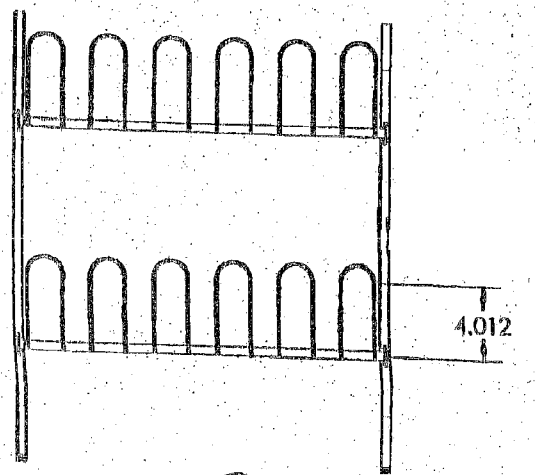
FIG. 8 is a front elevational view thereof.
Figure 9:
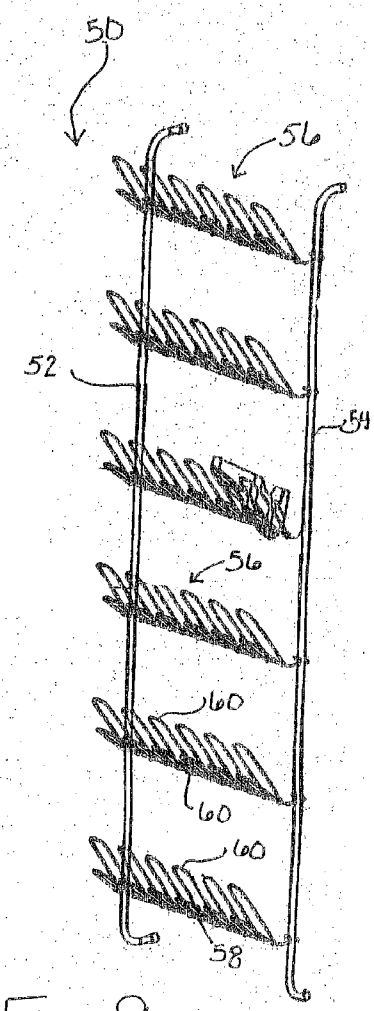
FIG. 9 illustrates a third embodiment of the hanging shoe rack of the present invention.

More particularly, as illustrated best in FIGS. 6 and 7, loops 40 are preferably positioned in loop pairs, designated by reference numerals 40*a*, 40*b*, 40*c*, 40*d*, 40*e*, and 40*f*. Additionally, unlike the embodiment as set forth in FIGS. 1–5, each loop of a pair extends upwardly from its corresponding cross-bar 38, but outwardly from its corresponding cross-bar 38 in a different direction. Preferably, each loop is positioned between 165° and 175° with respect to vertical. More preferably, each loop is positioned at approximately 170° with respect to vertical. Each plastic side frame member has connectors thereon for connecting one such shoe rack 30 with another shoe rack 30, or with another modular storage unit. In particular, each plastic side frame member 32, 34 has a female socket 33 and an upper end thereof, and a male member 35 at a lower end thereof. Additionally, each side frame member 32, 34 has a foot member 37 for receiving a hanger, which may be used to hang shoe rack 30 over an upright surface, such as a door.

With reference now to FIGS. 9–12, an alternate embodiment of the hanging shoe rack of the present invention is illustrated and described. In particular, with initial reference to FIG. 9, a hanging shoe rack of the present invention is denoted generally by reference numeral 50. Hanging shoe rack 50 has first and second side frame members, preferably formed of metal, designated generally by reference numerals 52, 54. A plurality of shoe retaining tiers 56 are positioned between metal side frame members 52, 54. Each shoe retaining tier is formed of a cross-bar 58 and a plurality of wire loops 60. Each shoe retaining tier 56 is connected to metal side frame members 52, 54 in a conventional manner. In particular, side frame members 52, 54 may be provided with a plurality of openings, such that outer ends of cross-bar 58 extend into and are securely received by, the openings.

Figure 10:
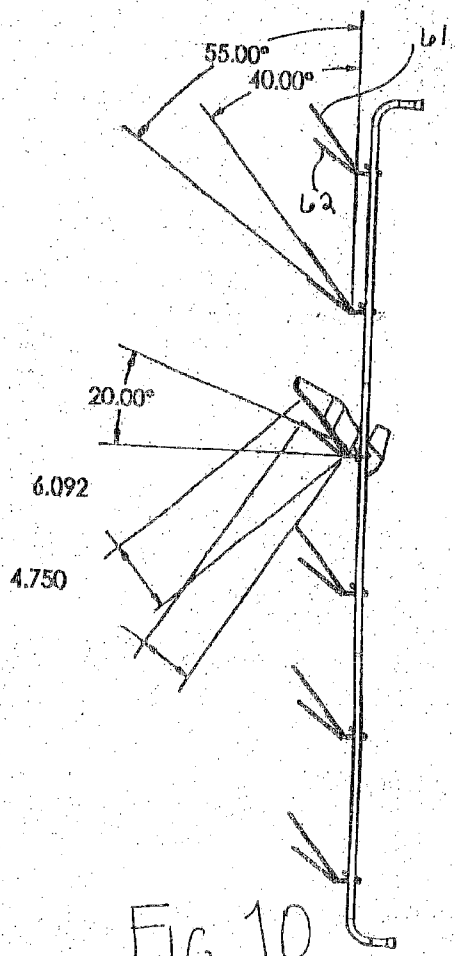
FIG. 10 is a left elevational view thereof.
Figure 11:
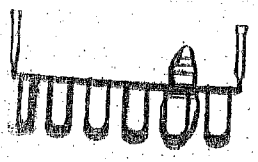
FIG. 11 is top plan view thereof.
Figure 12:
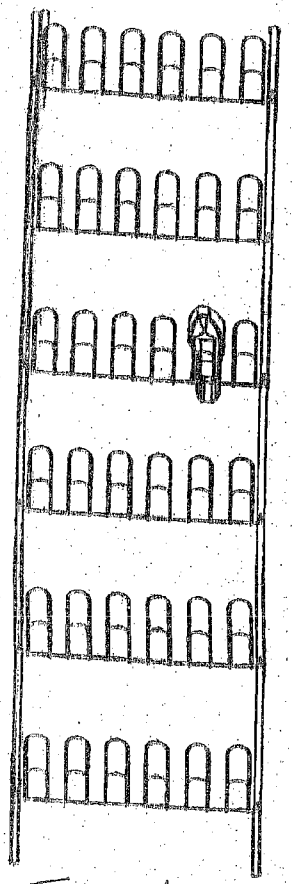
FIG. 12 is a front elevational view thereof.

In this embodiment, loops 60 are oriented in pairs, with each loop of the pair extending upwardly and outwardly in the same direction from its corresponding cross-bar 58. As illustrated, however, it is preferred that the loops are oriented such that a first loop of the pair, such as designated by loop 61 in FIG. 10, is positioned more upwardly than a second loop of the pair, such as designated by reference numeral 62. Additionally, it is preferred that the uppermost loop of a pair, (e.g., loop 61), is longer than the lowermost loop of a pair (e.g., loop 62). In this regard, it is preferred that the uppermost loop is between 5.5 and 6.5 inches in length, while the lowermost loop of the pair is between 4.5 and 5.5 inches in length. More preferably, the uppermost loop is approximately 6.1 inches in length, while the lowermost loop of the pair is approximately 4.75 inches. Regarding the preferred angular orientations of the loops, it is preferred that the uppermost loop of a pair (e.g., loop 61) is positioned between 37.5° and 42.5° with respect to vertical, preferably at 40°, while the lowermost loop of the pair (e.g., loop 62) is positioned between 52.5° and 57.5° with respect to vertical, preferably at 55°. However, other angular orientations may be utilized without departing from the spirit and scope of the invention.

With reference now to FIGS. 13–16, an alternate embodiment of the hanging shoe rack of the present invention is illustrated and described. In particular, the embodiment of FIGS. 13–16 is very similar to the embodiment illustrated above in conjunction with FIGS. 9–12. However, in this embodiment, the hanging shoe rack, denoted generally by reference numeral 70, has plastic side frame members 72, 74. Additionally, each of the plastic side frame members has male and female fastening components, such as in the embodiment of FIGS. 5–8, for modularly connecting one shoe rack 70 of the invention to another, as illustrated. Additionally, in this embodiment, each shoe retaining tier 76 also has a metal wire cross-bar 78, and a plurality of wire loops 80 positioned thereon (such as by a weldment). Each plastic side frame member 72, 74 contains a plurality of sockets and/or channels for receiving outer ends of respective metal wire cross-bars 78.

In this embodiment, the loops are again oriented in pairs, with each loop of a pair angled upwardly and outwardly in the same direction from its corresponding metal wire or cross-bar 78. As in the previous embodiment, the respective loops of a pair are preferably angled with respect to vertical at between 37.5° and 42.5°, more preferably 40° (for the uppermost loop of the pair), and between 52.5° and 57.5°, more preferably 55° (for the lowermost loop of the pair). In this embodiment, however, the uppermost loop of the pair is preferably between 7.0 and 7.5 inches in length. More preferably, the uppermost loop is approximately 7.1 inches in length, which is slightly longer than the length illustrated and described in the foregoing embodiment. The lowermost loop of the pair is preferably between 4.5 and 5.0 inches in length. More preferably, the lowermost loop is 4.750 inches in length. The loop pairs are preferably positioned approximately 12 inches from one another on the cross-bar.

Shoes may be positioned on the loops as illustrated. Additionally, it will be understood and appreciated that a shoe is desirably placed on the lowermost loop, as well as the uppermost loop, thus providing a great deal of shoe retaining space.

With reference now to FIGS. 17–20, an alternate embodiment of the hanging shoe rack of the present invention is illustrated and described. The embodiment of FIGS. 17–20 is very similar to the embodiment of FIGS. 13–16. The only difference is that the shoe retaining tiers 92 of the hanging shoe rack 90 are connected on inside surfaces of side frame members 94, 96. Connecting the wire shoe retaining tiers to the inside surface of the plastic is accomplished generally as set forth in U.S. Provisional Application No. 60/150,934, filed Aug. 26, 1999, entitled "Plastic and Wire Storage Unit", which is incorporated by reference herein, in its entirety.

Figure 21:
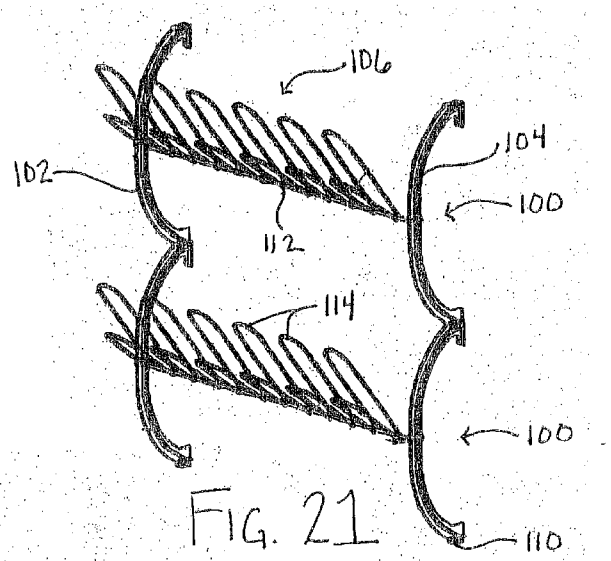
FIG. 21 is a perspective view of a sixth embodiment of the hanging shoe rack of the present invention.
Figure 22:
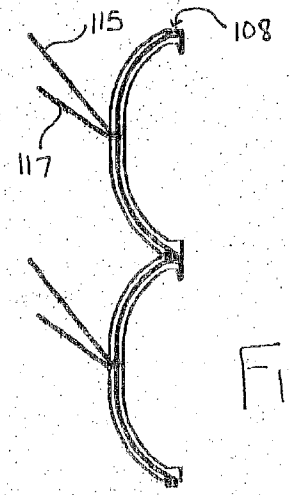
FIG. 22 is a left side elevational view thereof.
Figure 23:
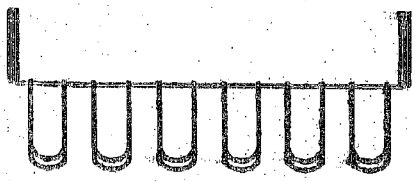
FIG. 23 is a top plan view thereof.
Figure 24:
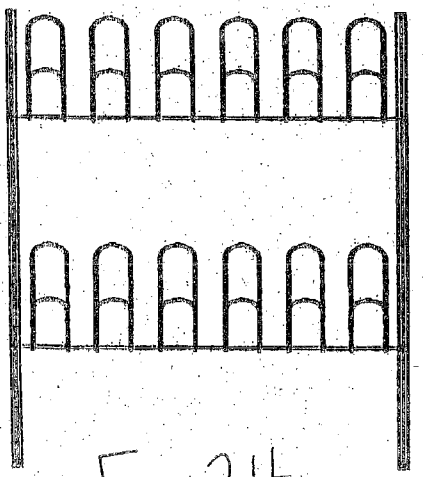
FIG. 24 is a front elevational view thereof.

With reference now to FIGS. 22–24, an alternate embodiment of the hanging shoe rack of the present invention is illustrated and described. In particular, with reference to FIG. 21, a hanging shoe rack of the present invention is denoted generally by reference numeral 100. Hanging shoe rack 100 has first and second plastic side frame members 102, 104, with a single shoe retaining tier 106 therebetween. As illustrated, the side frame members 102, 104 have connecting members for connecting one hanging shoe rack 100 with another hanging shoe rack 100. In particular, each plastic side frame member has a female member 108 positioned at an upper end thereof, and a male member 110 positioned at a lower end thereof.

In particular, as illustrated, each shoe retaining tier 106 has a metal wire cross-bar 112 and a plurality of loops 114, oriented in pairs, thereon. As illustrated, each loop of the pair extends upwardly and outwardly in the same direction from its corresponding metal wire cross-bar 112. Additionally, each upper loop of a pair (e.g., loop 115) is preferably longer in length than a corresponding lower loop of a pair (e.g., loop 117). In this embodiment, each wire shoe retaining tier 106 is preferably connected to its corresponding side frame members 102, 104 at an inside surface thereof, utilizing the technique illustrated and described in U.S. Provisional Application Serial No. 60/150,934, entitled "Plastic and Wire Storage Unit", incorporated by reference herein.

With reference now to FIGS. 25–28, an alternate embodiment of the present invention is illustrated and described. In particular, in the embodiment of FIGS. 25–28, the hanging shoe rack of the present invention, denoted generally by reference numeral 120, includes a number of modular components, as illustrated. This embodiment of the invention is very similar to the foregoing embodiment of the invention, with exception that each cross-bar, designated by reference numeral 122, is plastic, instead of metal wire. The loops, designated by reference numeral 124, however, are preferably formed of wire. Each loop 144 is positioned on its corresponding plastic cross-bar 122, by the provision of openings, channels, or slots in the plastic cross-bar 122, such that outer, bent ends of the metal wire loops may be positioned in the channels, sockets, or openings. In this regard, as will be understood and appreciated, free extending outer ends of the loops may be depressed inwardly for positioning in corresponding sockets or a channel or channels on the plastic cross-bar, and then released into a retained position. The uppermost loop of each loop pair is preferably positioned between 120° and 130° with respect to vertical. More preferably, the uppermost loop is positioned 125° with respect to vertical. The lowermost loop is preferably positioned approximately 15° further with respect to vertical than the uppermost loop.

With reference to FIGS. 29–32, an alternate embodiment of the hanging shoe rack of the present invention is illustrated and described. In particular, with initial reference to FIG. 29, a hanging shoe rack of the present invention is denoted generally by reference numeral 130. Hanging shoe rack 130 has first and second side frame members, preferably formed of plastic, designated generally by reference numerals 132, 134. A plurality of shoe retaining tiers, denoted generally by reference numeral 136, are positioned between respective side frame members 132, 134. Each shoe retaining tier 136 is formed of a pair of support arms 138, 140, a cross-bar 142 and a plurality of loops 144.

Each shoe retaining tier 136 is connected to plastic side frame members 132, 134 in a conventional manner. In particular, in this embodiment, each shoe retaining tier 136 is positioned on a front of the shoe rack 130, and particularly, on a front surface 175 of each of the respective side frame members 132, 134. Such a connection is accomplished by the provision of interlocking means on the front face of each of the side frame members 132, 134, and on the respective proximal ends of support arms 138, 140. Each shoe retaining tier 136 could be connected to side frame members 132, 134 in a number of manners. In this regard, while a shoe rack of the present invention has not heretofore been known, the connection of various plastic components to one another is known, and there are many conventional arrangements for accomplishing such connections.

In this embodiment, support arms 138, 140 preferably are formed of plastic and are formed separately from side frame members 132, 134. Each of support arms 138, 140 projects outwardly from its corresponding side frame member 132, 134 and is removably connected thereto. In particular, each support arm 138, 140 has, at a first end 146, a connection component, such as a male member 148, which fits snugly yet releasably into a corresponding connection component, such as a female socket 150, on the respective side frame member 132, 134. The combination of separate formation of the support arms 138, 140 and this type of releasable connection has a number of advantages. For example, it allows both for less expensive replacement and repair in the event of a break or fracture in one of the side frame members or shoe retaining tiers. Further, it allows for a storage unit other than a shoe retaining tier to attach to the side frame members, e.g., a basket or shelf with a similar support arm arrangement. It will be understood and appreciated, however, that the side frame members 132, 134 and support arms 138, 140 may be integrally formed as disclosed in U.S. Pat. No. 5,695,073, incorporated by reference herein. Such is contemplated to be within the scope of the present invention.

At the second, distal end 152 of each support arm 138, 140, cross-bar 142 is connected in a conventional manner. In particular, the distal end 152 of each support arm 138, 140 may be provided with a socket, such that each outer end of cross-bar 142 extends into, and is securely received by, the socket in the respective support arm 138, 140.

Preferably, the distance between the distal end 152 of each support arm 138, 140 and the upright surface upon which the shoe rack of the present invention is positioned and used, is between 4.5 and 6.5 inches. More preferably, the distance between the distal end 152 of each support arm 138, 140 and the upright surface is approximately 5.4 inches.

Figure 33:
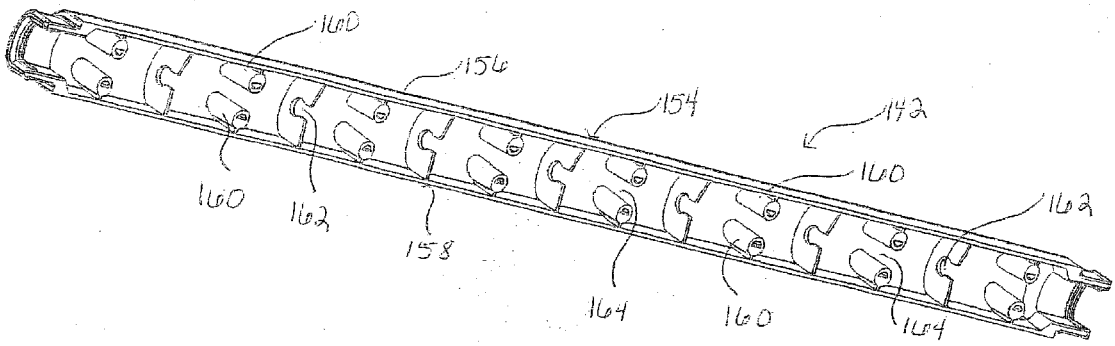
FIG. 33 is a perspective view of a cross-bar utilized in a shoe rack of the present invention.
Figure 35:
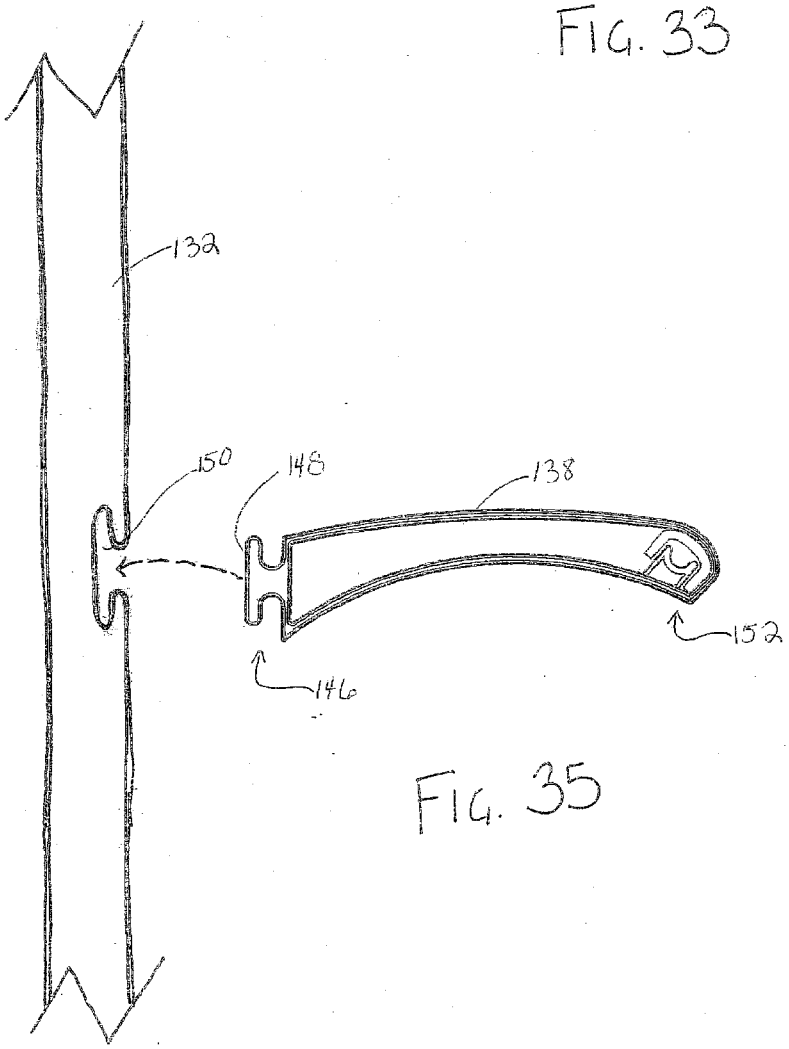
FIG. 35 is a perspective view of a support arm of the present invention illustrating its attachment to a side frame member.
Figure 34:
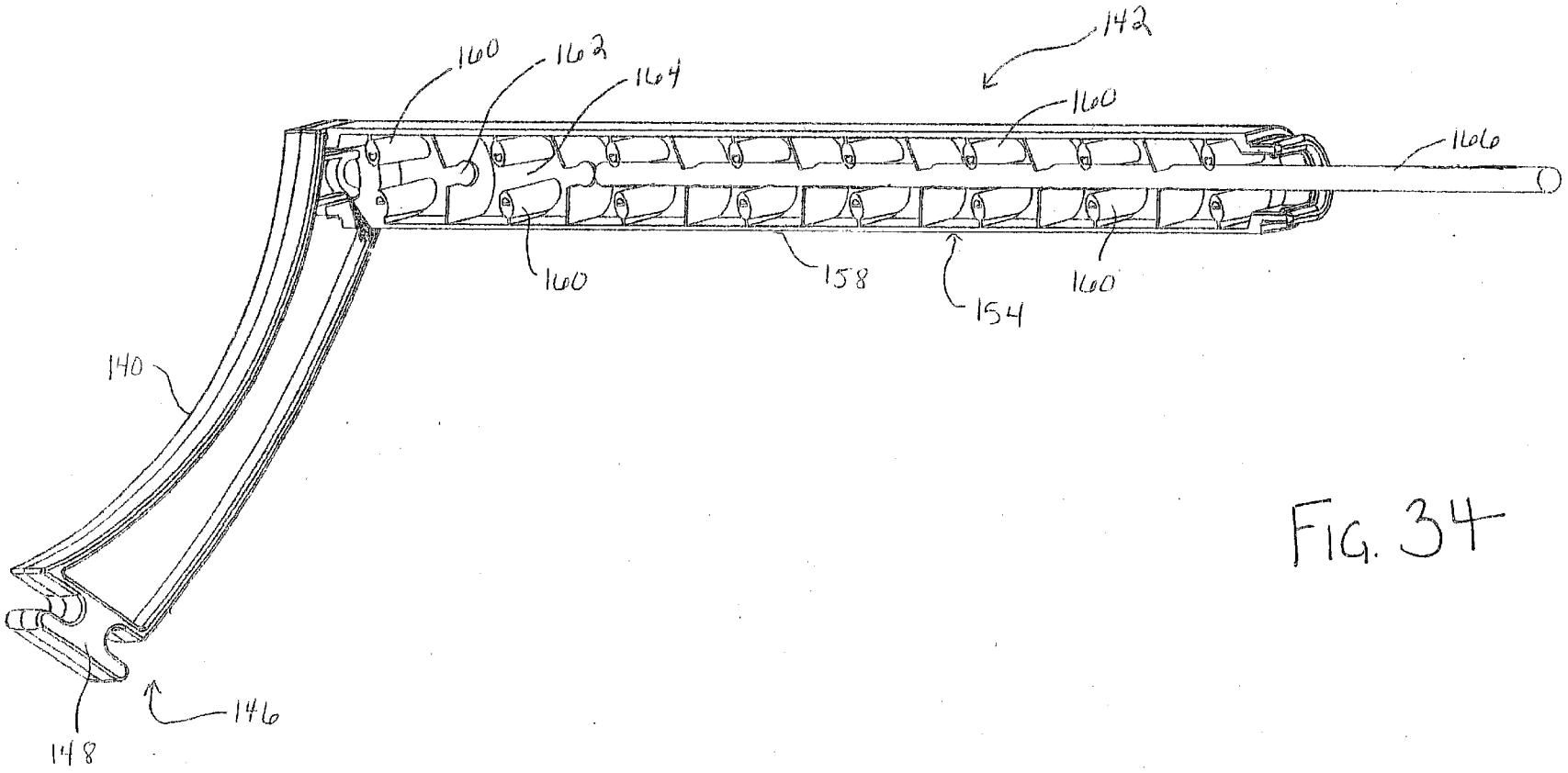
FIG. 34 is perspective view of a cross-bar utilized in a shoe rack of the present invention illustrating attachment of the bar to the support arm as well as insertion of a reinforcing member.

A preferred construction of cross-bar 142 is illustrated in FIGS. 33 and 34. As set forth in U.S. Provisional Application Serial No. 60/175,874, filed Jan. 13, 2000 and entitled "Plastic and Wire Shoe Rack", cross-bar 142 is preferably formed of an integrally molded plastic housing 154 having first and second elongate side walls 156, 158. U.S. Provisional Application Serial No. 60/175,874 is incorporated by reference herein, in its entirety. A plurality of hollow cylinders 160 are positioned in pairs along respective sides of housing 154. Hollow cylinders 160 are adapted for receipt of opposing ends of wire loops 144, as more fully described below. Between each pair of hollow cylinders is a channel 164 sized for receipt of a reinforcement member 166, also more fully described below. Along the length of the cross-bar 142 and between each pair of cylinders, is a plurality of slots 162, each slot also sized for receipt of reinforcement member 166.

Preferably, the length between opposing ends of cross-bar 142 is between 18 and 18.5 inches. More preferably, the cross-bar is approximately 18.3 inches in length. A cross-bar of this length is contemplated to accommodate up to five pairs of loop pairs thereon. Preferably, either four or five loop pairs are positioned on each cross-bar 142.

Preferably, the distance between consecutive shoe retaining tiers, measured from the horizontal axis defined by a support arm of one shoe retaining tier and the horizontal axis defined by a support arm of a second shoe retaining tier, is between ten and twelve inches. More preferably, the distance between consecutive shoe retaining tiers is approximately eleven inches.

For adding stability and structural integrity to the shoe rack, a reinforcement member, preferably made of metal and designated generally by reference numeral 166, is positioned within the slots 162 and channels 164 of cross-bar 142. Thus, the slots 162 and channels 164 effectively form a tunnel for receipt of the reinforcement member 166. As will be appreciated, the reinforcement member 166 is positioned as illustrated in FIG. 34, within the channel either by sliding the bar into its illustrated position from one end of the cross-bar 142, or by snapping it into place from the open end of the channels 164 and slots 162. As illustrated in FIG. 34, and as previously described, each of the outer ends of crossbar 142 is positioned within a respective socket located on a corresponding outer end of a support arm for securing the cross-bar 142 to the shoe rack 130. In the preferred embodiment, opposed outer ends of wire loops 144 are positioned into the openings in hollow cylinders 160 and secured.

Figure 29:
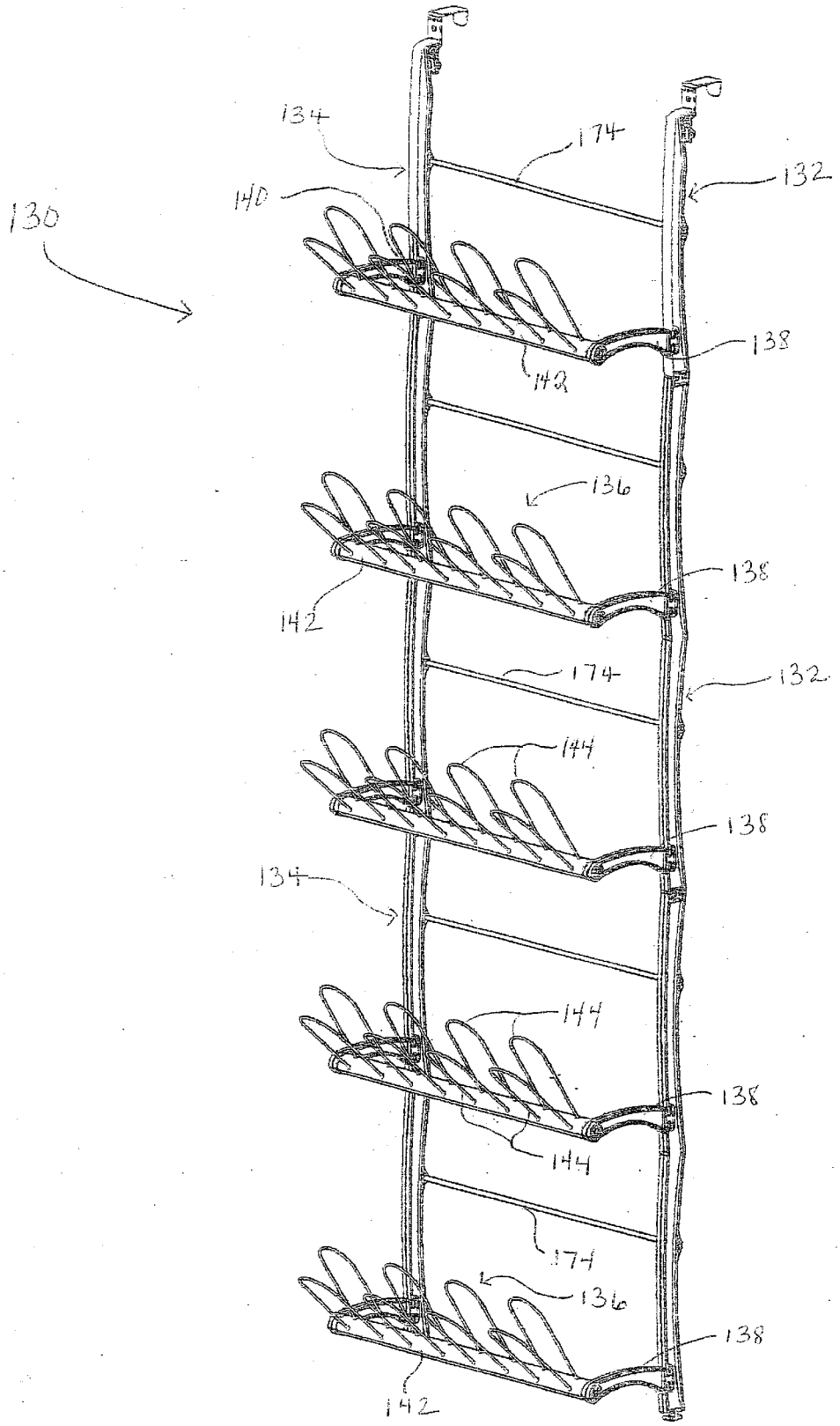
FIG. 29 illustrates a perspective view of an eighth embodiment of the hanging shoe rack of the present invention.
Figure 30:
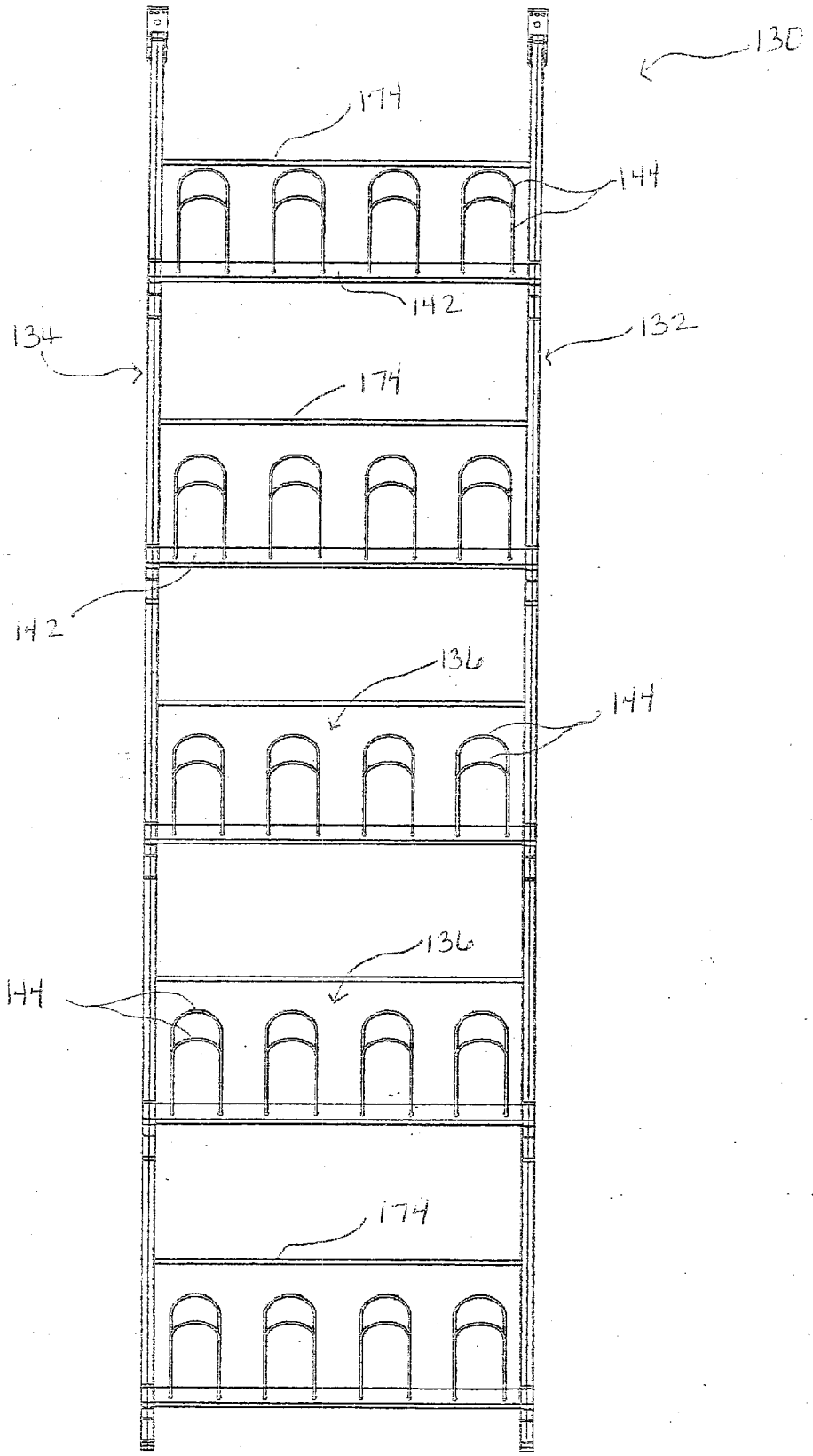
FIG. 30 is a front elevational view thereof.
Figure 31:
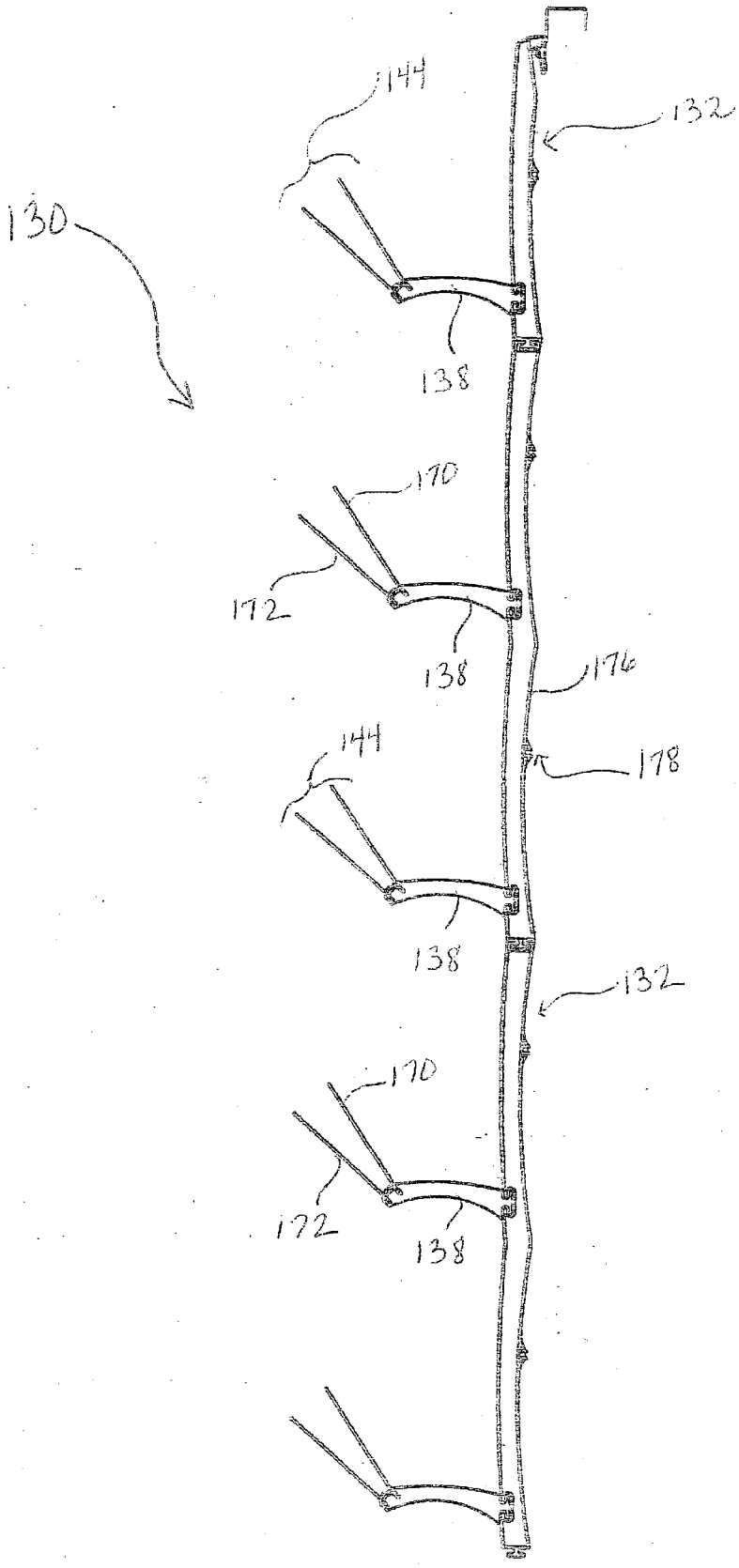
FIG. 31 is right side elevational view thereof.
Figure 32:
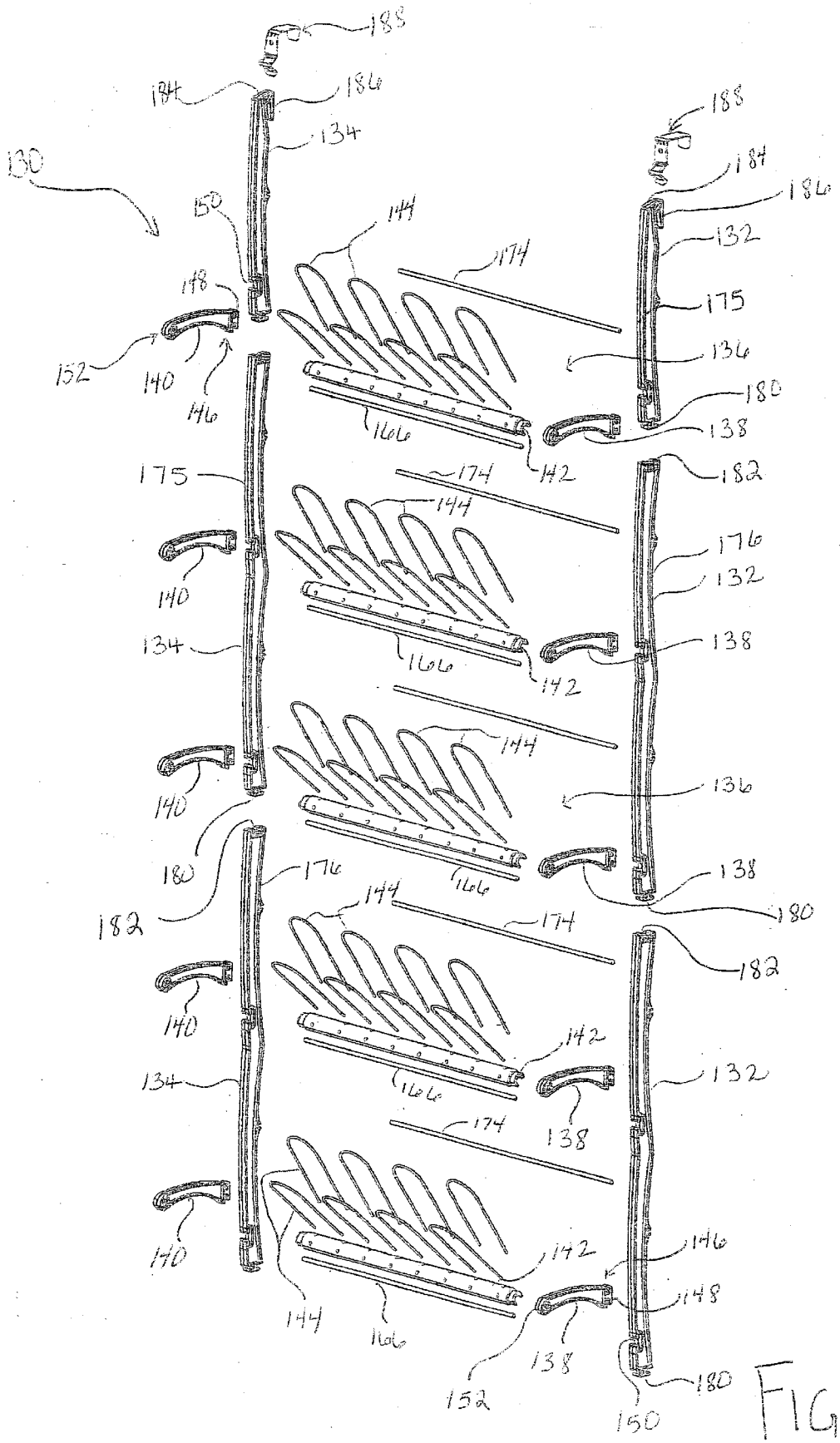
FIG. 32 is an exploded view thereof.

In the embodiment illustrated in FIGS. 29–32, wire loops 144 are preferably positioned in loop pairs. As with the embodiment shown and described in FIGS. 1–5, each loop of the pair extends upwardly and outwardly in the same direction from its corresponding cross-bar 142. As illustrated, however, it is preferred that the loops are positioned such that the first, uppermost loop of the pair, such as designated by loop 170 in FIG. 29, is positioned more upwardly than the second loop of the pair, such as designated by reference numeral 172. It is further preferred that the loops of each pair be approximately the same length. However, it will be understood and appreciated that loops of varying lengths may be utilized and are contemplated within the scope of the present invention.

As illustrated, the first loop 170 of each loop pair is preferably positioned between 120° and 125° with respect to a horizontal axis extending through opposing ends of each support arm. More preferably, the first loop 170 is positioned 123.50° with respect to the horizontal axis. Preferably, the second loop 172 of each loop pair is positioned between 135° and 140° with respect to the horizontal axis extending through opposed ends of each support arm. More preferably, the second loop 172 is positioned 138.50° with respect to the horizontal axis. It will be understood and appreciated that different angular positions may be utilized. In particular, the preferred angular orientation, whether it be that illustrated or another angular orientation, results in each of the loops of each loop pair being angled outwardly from its corresponding cross-bar 142 in the same direction with respect to vertical. In particular, each of the loops 144 is angled outwardly in a direction away from an upright surface on which the shoe rack 130 is positioned and used. As such, each loop is accessible for positioning and retaining a shoe.

Similarly to that previously described with reference to FIGS. 25–28, each loop 144 is positioned on its corresponding plastic cross-bar 142, by the provision of openings in cylinders 160 positioned along the length of cross-bar 142, such that outer, bent ends of the metal wire loops may be positioned in the openings. In this regard, as will be understood and appreciated, free extending outer ends of the loops may be depressed inwardly for positioning in corresponding cylinders on the plastic cross-bar and then released into a retained position.

Each loop of the loop pair has a proximal end and a distal end. The proximal end is positioned proximate to the support arm and is comprised of the two loop ends which are attached to the support arm as previously described. The distal end of each loop is the end oriented furthest from the support arm and peaks at the center of the length of the loop. Preferably, the distance from the distal end of the second loop 172 of each loop pair to the upright surface upon which the shoe rack is positioned and used, is between 7.5 and 9.5 inches. More preferably, the distance from the distal end of the second loop 172 to the upright surface is approximately 8.6 inches. It will be understood and appreciated, however, that a variety of distances may be utilized so long as structural integrity sufficient to support shoes on the shoe rack of the present invention is maintained.

The shoe rack as illustrated in FIGS. 29–32, further includes at least one reinforcement bar 174 positioned between side frame members 132, 134 for adding structural integrity to the shoe rack 130. Reinforcement bar 174 is preferably formed of wire, although a bar of any material that would increase the structural integrity of shoe rack 130 is contemplated to be within the scope of the present invention. It is preferred that reinforcement bar 174 is in the form of a coated wire rod. The connection of the reinforcement bar 174 to the side frame members 132, 134, may be accomplished in any desirable way, but is preferably accomplished through utilization of interlocking and mating components located on the rear surface 176 of side frame members 132, 134. In particular, a generally C-shaped socket 178 having one open end, the open end facing rearwardly, extends from each of side frame members 132, 134. Reinforcement bar 174 may either snugly "snap" through the open end of the C-shaped socket 178 or may be inserted into the socket from either side thereof, as though the socket were completely closed. It will be understood and appreciated that other types of connection components may be utilized. For example, side frame members 132, 134 may have sockets for receiving outer ends of reinforcement bar 150, which itself may have posts for snug and secure insertion into respective sockets. Such is contemplated to be within the scope of the present invention.

It is preferred that shoe rack 130 include one reinforcement bar 174 positioned between each shoe retaining tier 136 to add structural stability to the shoe rack. However, it is understood and appreciated that any number of reinforcement bars positioned at any desirable location between side frame members 132, 134, is contemplated to be within the scope of the present invention.

Each plastic side frame member 132, 134 includes connectors thereon for modularly connecting one shoe rack 130 with another shoe rack, or other type of storage unit. In particular, each plastic side frame member 132, 134 has a male member 180 at a lower end thereof. The upper end of each side frame member 132, 134 may be constructed in one of a number of different ways. The upper end of the side frame members 132, 134 may include female sockets 182 thereon for connecting to the male member 180 at the bottom end of a second storage rack. Alternatively, the upper end of the side frame members 132, 134 may include structure for receiving a hanger 188, which may be used to hang shoe rack 130 over an upright surface, such as a door. Yet another alternative for the upper end of side frame members 132, 134 includes both structure for mating to a second storage unit and structure for receiving a hanger. Each of these constructions, as well as a construction wherein a hanger is directly incorporated onto the side frame members, is within the scope of the present invention.

In an alternate embodiment, each plastic side frame member 132, 134 has a front surface 175 and a rear surface 176. The front surface 175, from which the support arms of the shoe retaining tiers extend, defines a substantially vertical line between top and bottom ends thereof. The rear surface 176, however, takes on a somewhat different configuration. Each side frame member 132, 134 has an upper portion, a central portion and a lower portion. In the alternate embodiment, the thickness of the side frame member is greater at each of the upper and lower portions than it is at the middle portion. Given that the front surface of the side frame member 132, 134 is substantially vertical, this discrepancy in thickness causes the rear surface to take on a bowed configuration with the width between the front and rear surfaces being greater at or near the upper and lower portions than it is in the center portion. This configuration adds stability and structural integrity to the construction.

In a side frame member having more than one shoe retaining tier extending therefrom, the bowed configuration would repeat relative to each tier. In other words, in a shoe rack having two shoe retaining tiers extending therefrom, if one were to divide the side frame members in half between the top and bottom ends thereof, each half would include an upper, a middle and a lower portion and follow the configuration described above. In the preferred embodiment, the support arms of each shoe retaining tier extend from the lower portion of each side frame member or section thereof, as previously described.

In side frame members which include components for receiving a hanger, it is preferred that at the upper end of the side frame member, the rear surface of the member begin to taper toward the front surface, although stopping short of reaching the front surface. At the top of the upper end of the side frame member, it is preferred that a transverse leg portion 184 extend rearwardly from the side frame member, and a vertical foot portion 186 extending from the outer end of the leg portion 184. The vertical foot portion 186 may be received in a hanger as more fully described below.

Shoe rack 130 is adapted to be supported on an upright surface, such as a wall or door. For hanging shoe rack 130 over an upright surface, a pair of hangers 188 are placed over the top of the upright surface and engage with shoe rack 130 to support shoe rack 130 in suspended fashion in engagement with the upright surface. U.S. Pat. No. 5,855,279, entitled "Hanging Shoe Rack", is directed to a hanger for hanging shoe racks of the type disclosed herein. The present invention incorporates such a hanger, albeit with different features. U.S. Pat. No. 5,855,279 is incorporated by reference, in its entirety, herein.

Figure 38:
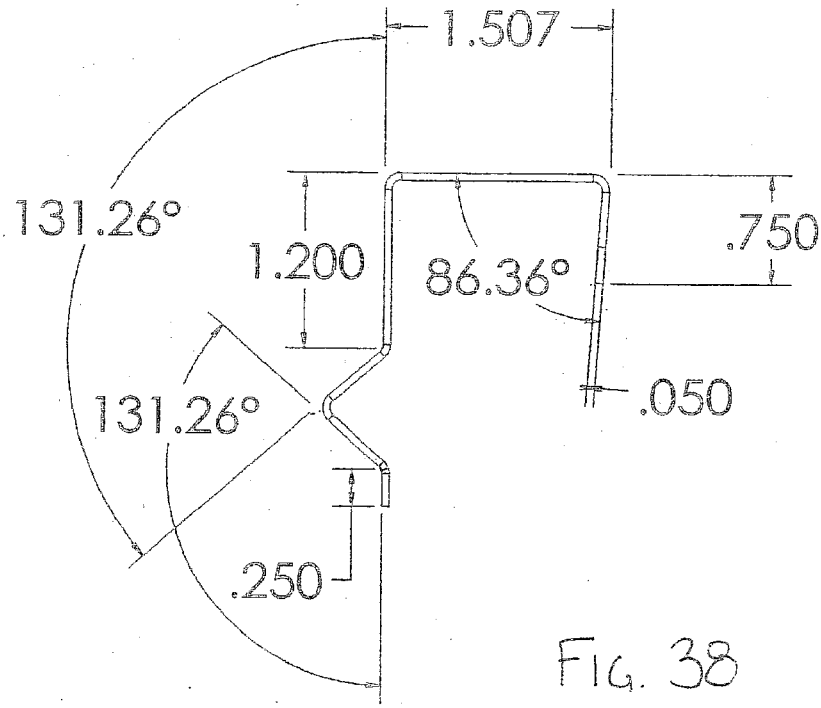
FIG. 38 is a side view of the hanger illustrating its dimensions.

Each hanger 188 is preferably in the form of a metallic bracket having a horizontal upper portion 190 and downwardly depending front and rear portions 192, 194, respectively, depending downwardly from respective front and rear edges of the upper horizontal surface 190. Preferably, the downwardly depending front portion 192 includes a portion, designated by reference numeral 196, angled into a V-shape including angled portions 198, 200 which meet at an outwardly protruding apex 202. Each angled portion 198, 200 includes an aperture 204*a*, 204*b* adapted to receive the vertical foot portion 186 of the corresponding side frame member 132, 134. Apertures 204*a* and 204*b* are of substantially the same dimensions. Extending from second angled portion 200 as shown in FIG. 38, is a bottom vertical portion 206. The inverted "U" formed by each hanger 188 is adapted to hang over the top of the upright surface, thus rigidly supporting shoe rack 130 in suspended fashion on the upright surface.

The horizontal upper portion 190 of hanger 188 is between 1.40 and 1.60 inches in length. Preferably, horizontal upper portion 190 is approximately 1.50 inches in length. Depending rear portion 194 does not depend in a perfectly vertical fashion. It is preferred that the angle between rear depending portion 194 and horizontal upper portion 190 is between 85° and 87°. More preferably, this angle is approximately 86.36° as shown in FIG. 38. Front depending portion 192 is between 1.10 and 1.30 inches in length. More preferably, the length of front depending portion 192 is 1.20 inches.

The angular position of the first angled portion 198, defined from the vertical line created by front depending portion 194 and the line created by angled portion 198, is preferably between 130° and 132°. More preferably, this angular orientation is 131.26° as shown in FIG. 38. The angular orientation of the second angled portion 200, defined from the vertical line created by front depending portion 194 and the line created by angled portion 200, is also preferably between 130° and 132°. As illustrated in FIG. 38, this angular orientation is 131.26° in the preferred embodiment. Bottom vertical portion 206 is preferably between 0.20 and 0.30 inches in length. In the preferred embodiment, this length is approximately 0.25 inches.

Figure 39:
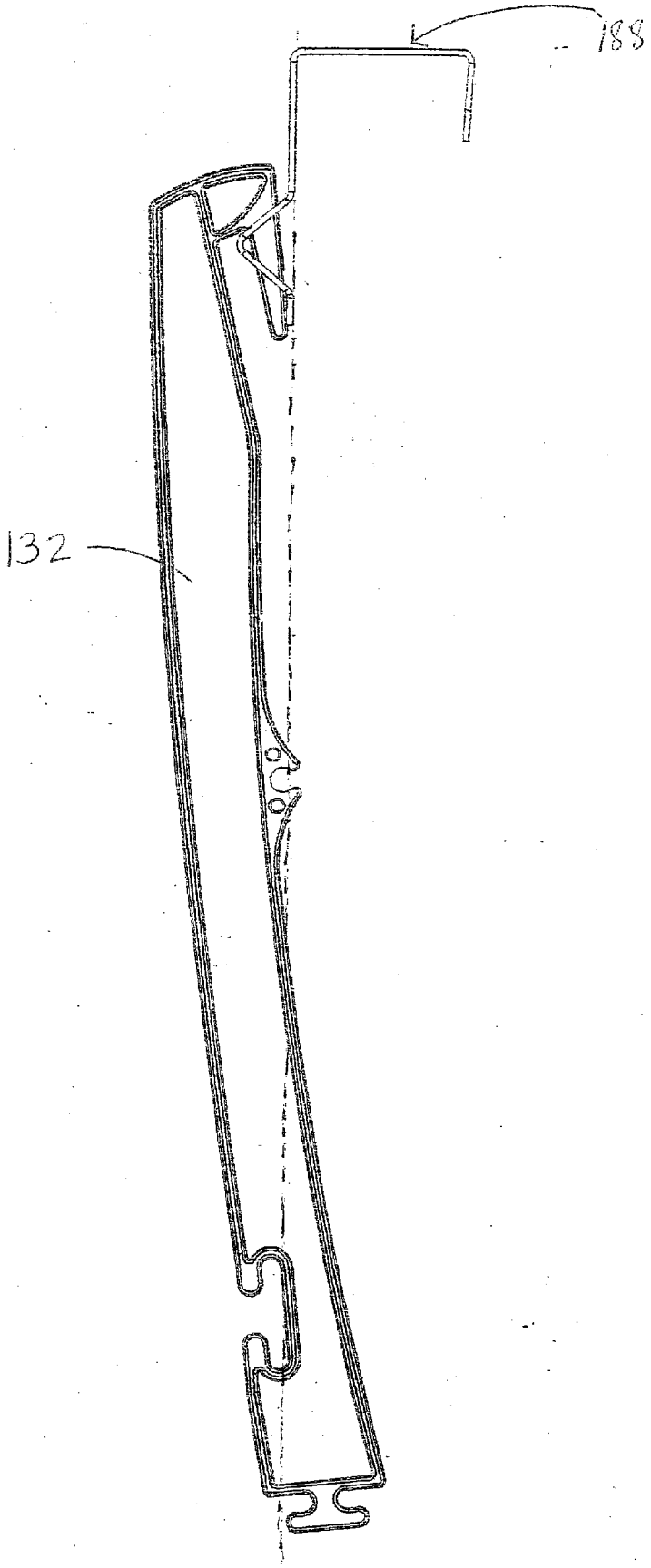
FIG. 39 is a perspective view of a side frame member of the present invention inserted into a hanger of the type illustrated in FIG. 37.

Aperture 204*a* in first angled portion 198 is offset from aperture 204*b* in second angled portion 200. Accordingly, aperture 204*a* is more proximate apex 202 than aperture 204*b* and is positioned substantially above aperture 204*b*. This configuration aids in forcing side frame members 132, 134 toward the upright surface upon which it is positioned and used as illustrated in FIG. 39. This force increases the stability of hanging shoe rack 130.

The shoe racks of the present invention are preferably oriented to define a shoe rack system with a plurality of shoe racks modularly connected to one another as described above. In a preferred embodiment, the shoe rack system is comprised of three shoe racks connected to one another. Oriented from top to bottom, the first shoe rack of the system is preferably approximately one-half the length of the second and third shoe racks of the system, with the second and third shoe racks being approximately the same length. Accordingly, in the preferred embodiment, the first shoe rack has one shoe retaining tier extending therefrom while there are two shoe retaining tiers extending from each of the second and third shoe racks. Thus, there are preferably five shoe retaining tiers in the shoe rack system. Accordingly, in the embodiment in which each cross-bar of the shoe retaining tiers has four loop pairs thereon, the shoe rack system will accommodate twenty pairs of shoes. Alternatively, in the embodiment in which each cross-bar of the shoe retaining tiers has five loop pairs thereon, the shoe rack system will accommodate twenty-five pairs of shoes. It will be understood and appreciated, however, that the shoe rack system of the present invention may be made with any number of shoe retaining tiers and may be customized to fit upon the upright surface upon which it will be positioned and used. It will be further appreciated that a combination of cross-bars comprising four loop pairs and cross-bars comprising five loop pairs may be utilized and is contemplated to be within the scope of the present invention.

In a shoe rack system comprising three shoe racks, the first of which is approximately one-half the length of the second and third racks as described above, the total length of the shoe rack system measured from the top of the first shoe rack to the bottom of the third shoe rack preferably is between fifty and sixty inches. More preferably, the total length of the shoe rack system is approximately 55 inches. In an embodiment incorporating a hanger as illustrated in FIG. 39, the total length of the shoe rack system from the horizontal upper surface of the hanger to the bottom of the third shoe rack preferably also is between 50 inches and 60 inches. More preferably, the total length of the shoe rack system is approximately 56 inches.

Figure 36A:
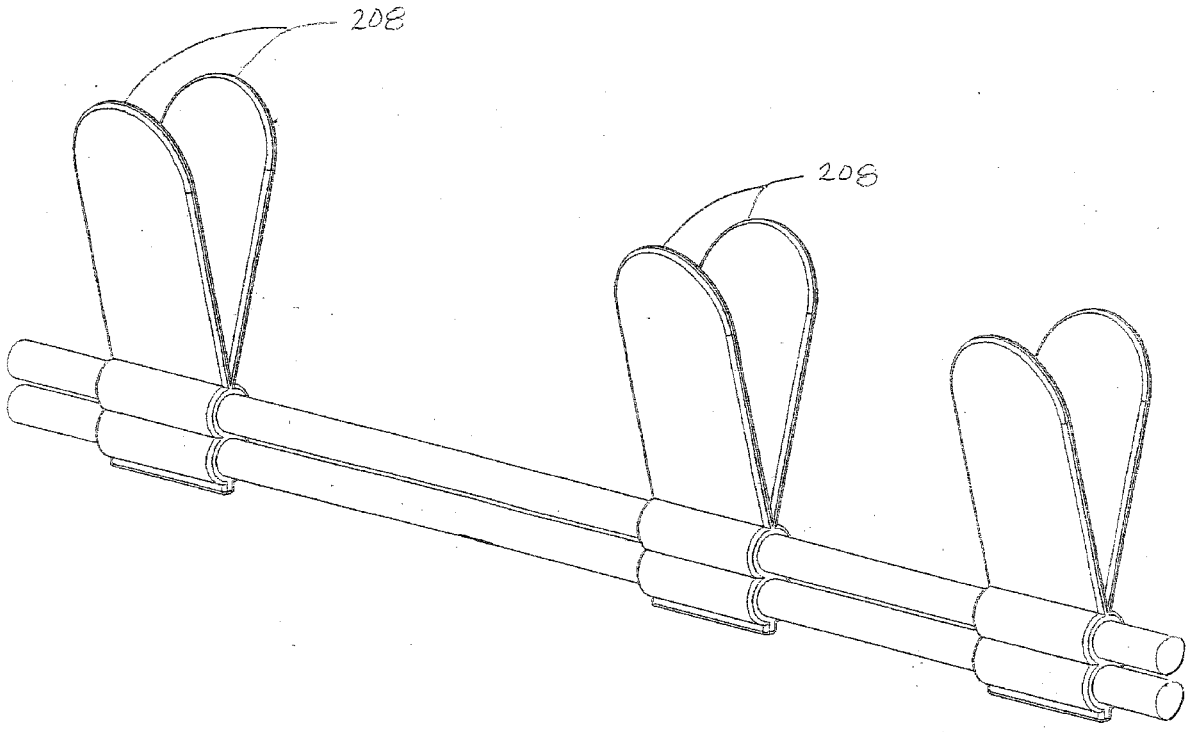
FIG. 36*a* is a perspective view of a ninth embodiment of the present invention.
Figure 36B:
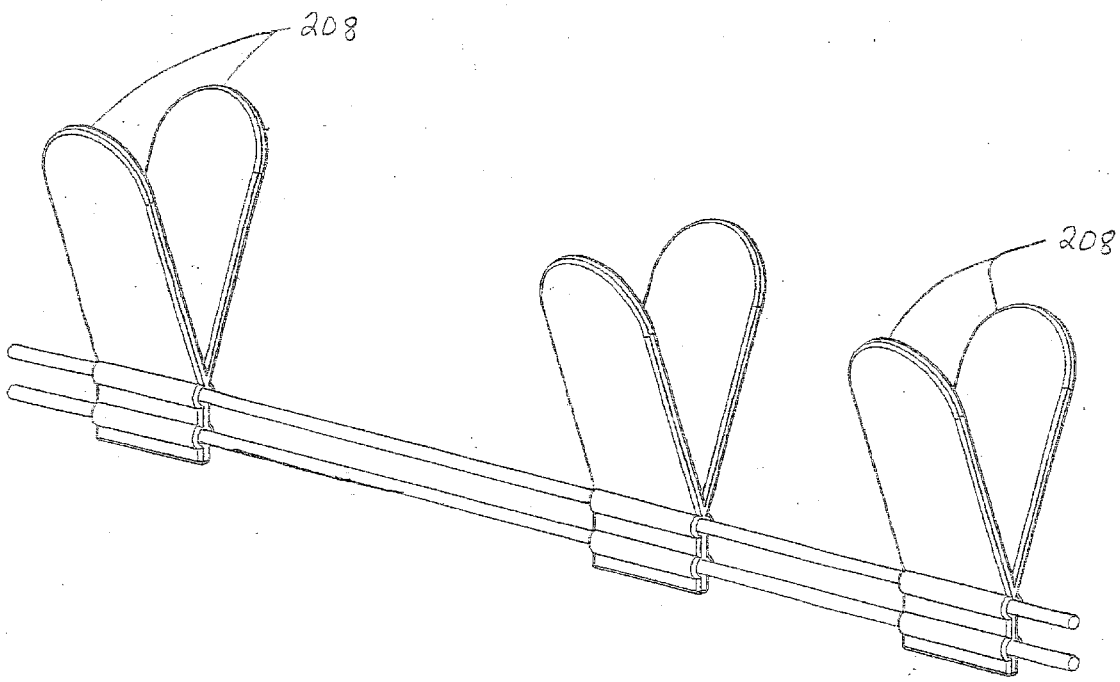
FIG. 36*b* is a first variation of the ninth embodiment of the present invention.
Figure 3B:
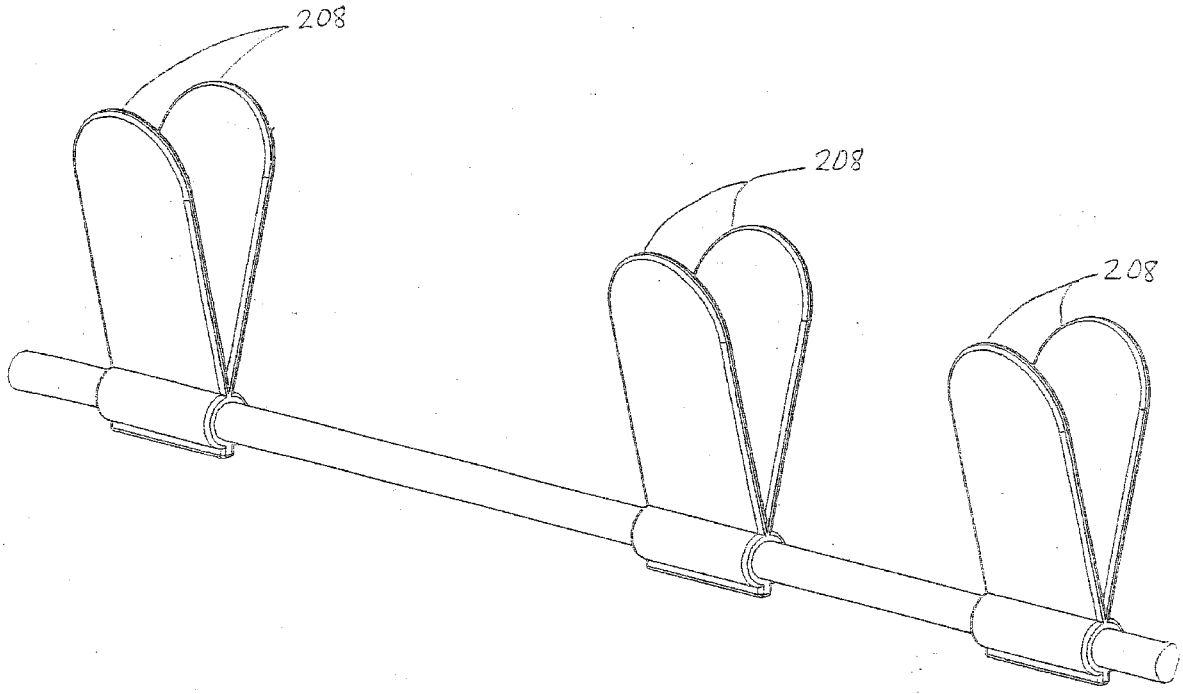
Figure 37:
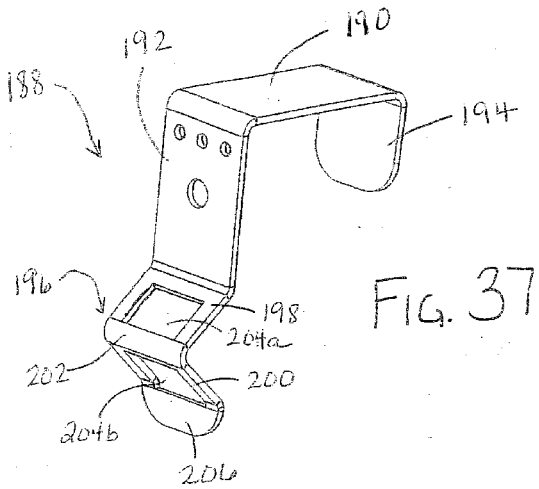
FIG. 37 is a perspective view of a hanger which may be utilized with each embodiment of the present invention.

FIGS. 36*a*, 36*b* and 36*c* illustrate an alternate embodiment of the cross-bar and loops included in the shoe retaining tiers of the present invention. Each embodiment illustrates a cross-bar upon which adjustable, plastic shoe holders 208 are slidably positioned. Thus, the shoe holding loop pairs may be adjusted further apart to accommodate larger, bulkier pairs of shoes, or may be adjusted closer together to accommodate a greater number of shoe pairs on a single cross-bar, if the size of the shoes allows for such orientation.

In FIG. 36*a*, the cross-bar is comprised of a pair of substantially parallel bars, preferably in the form of plastic or metal tubes. In FIG. 36*b*, the cross-bar is comprised of a pair of substantially parallel wires. In FIG. 36*c*, the cross-bar is comprised of a single plastic or metal tube. In each embodiment, it will be understood and appreciated that the slidable connectors of the, adjustable shoe holders 208 may be modified accordingly, and such is contemplated to be within the scope of the present invention. In particular, each embodiment of FIGS. 36*a*, 36*b* and 36*c* comprises a pair of adjustable shoe holders each having a rigid, U-shaped wing portion and an attachment portion, wherein the cross-bar extends through an aperture in the attachment portion for sliding movement about the cross-bar. Each of the wing portions and attachment portions preferably are formed of plastic. Each of the wing portions projects outwardly from its respective attachment portion. Each such configuration is contemplated within the scope of the present invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A shoe rack for positioning on an upright surface, said shoe rack comprising:

first and second side frame members;

at least one shoe retaining tier positioned between said first and second side frame members, said shoe retaining tier comprising a cross-bar extending between first and second side frame members, and having a plurality of loops thereon, said loops oriented in pairs, wherein said loops of each of said pair extends upwardly from their corresponding cross-bar and outwardly from their corresponding cross-bar in the same direction, albeit at different angles with respect to vertical.

2. The shoe rack as set forth in claim 1, wherein one loop of each said pair has a different dimension than the other loop of each of said pair.

3. The shoe rack as set forth in claim 1, wherein one loop of each said pair is longer than the other loop of each of said pair.

4. The shoe rack as set forth in claim 1, wherein one loop in each pair is oriented between 37.5° and 42.5° with respect to vertical, and another loop in each pair is oriented between 52.5° and 57.5° with respect to vertical.

5. The shoe rack as set forth in claim 4, wherein said one loop in each pair is oriented approximately 40° with respect to vertical, and said another loop in each pair is oriented at approximately 55° with respect to vertical.

6. The shoe rack as set forth in claim 1, wherein said first and second side frame members are formed of plastic, said cross-bars are formed of plastic, and said loops are formed of plastic.

7. The shoe rack as set forth in claim 1, wherein said first and second side frame members are formed of plastic, said cross-bars are formed of wire, and said loops are formed of wire.

8. The shoe rack as set forth in claim 1, wherein said first and second side frame members are formed of plastic, said cross-bars are formed of plastic, and said loops are formed of wire.

9. The shoe rack as set forth in claim 1, wherein said first and second side frame members are formed of metal, said cross-bar is formed of wire, and said loops are formed of wire.

10. The shoe rack as set forth in claim 1, where said cross-bar is formed of wood.

11. A shoe rack for positioning on an upright surface, said shoe rack comprising:

first and second opposed side frame members; and at least one shoe retaining tier positioned between said side frame members, said shoe retaining tier including first and second support arms, said first support arm projecting outwardly from said first side frame member and said second support arm projecting outwardly from said second side frame member, and a cross-bar extending between said support arms, wherein said cross-bar has a plurality of loops thereon, said loops oriented in pairs, wherein a first loop of each said loop pair extends upwardly from its corresponding cross-bar and outwardly from its corresponding cross-bar in the same direction as a second loop of each said loop pair, albeit at different angles with respect to vertical.

12. The shoe rack as set forth in claim 11, wherein said cross-bar includes four pairs of loops thereon.

13. The shoe rack as set forth in claim 11, wherein said cross-bar includes five pairs of loops thereon.

14. The shoe rack as set forth in claim 11, wherein each said support arm defines a horizontal axis extending through opposed ends thereof.

15. A shoe rack for positioning on an upright surface, said shoe rack comprising:

first and second side frame members;

at least one shoe retaining tier positioned between said first and second side frame members, said shoe retaining tier comprising a cross-bar extending between first and second side frame members, and having a plurality of loops thereon, said loops oriented in pairs with one loop in each pair being located outwardly from another loop in each pair and said one loop and said another loop in each pair extending upwardly and outwardly from the corresponding cross-bar at different angles with respect to vertical.

* * * * *